United States Patent [19]

Weber et al.

[11] 4,429,850

[45] Feb. 7, 1984

[54] DISPLAY PANEL SHELF BRACKET

[75] Inventors: Karl Weber, Laguna; Michael Schlinger, Yorba Linda; Richard Beedle, Costa Mesa, all of Calif.

[73] Assignee: Uniweb, Inc., Ahaheim, Calif.

[21] Appl. No.: 361,785

[22] Filed: Mar. 25, 1982

[51] Int. Cl.[3] ..... A47G 29/02

[52] U.S. Cl. ..... 248/250; 108/108; 211/193

[58] Field of Search ..... 248/243, 246, 235, 239, 248/241, 245, 247, 250, 223.4; 108/108; 211/193, 186, 187

[56] References Cited

U.S. PATENT DOCUMENTS

| | | | |
|---|---|---|---|
| 2,477,771 | 8/1949 | Sanford | 248/250 X |
| 3,202,296 | 8/1965 | Diack | 211/186 X |
| 3,212,836 | 10/1965 | Johnson | 211/193 X |
| 3,985,083 | 10/1976 | Pofferi | 248/250 X |

FOREIGN PATENT DOCUMENTS

| | | | |
|---|---|---|---|
| 864066 | 4/1941 | France | 248/250 |
| 672277 | 5/1972 | United Kingdom | 211/186 |

*Primary Examiner*—J. Franklin Foss

*Attorney, Agent, or Firm*—Poms, Smith, Lande & Rose

[57] ABSTRACT

A shelf bracket for removably attaching shelves to a display panel. The bracket is of unitary construction and particularly adaptable to be formed by extrusion of aluminum, or the like. The bracket comprises a back portion adapted to grip the panel and having two parallel portions extending horizontally therefrom. The parallel portions are spaced apart the thickness of the shelf. The lower parallel portion has a front edge with a high coefficient of friction and extends outward from the back portion a distance sufficient that the weight of the shelf extending therebeyond causes a rotational force against the gripping front edge sufficient to prevent the shelf from pulling out from between the two parallel portions in normal use.

3 Claims, 3 Drawing Figures

Fig. 1.
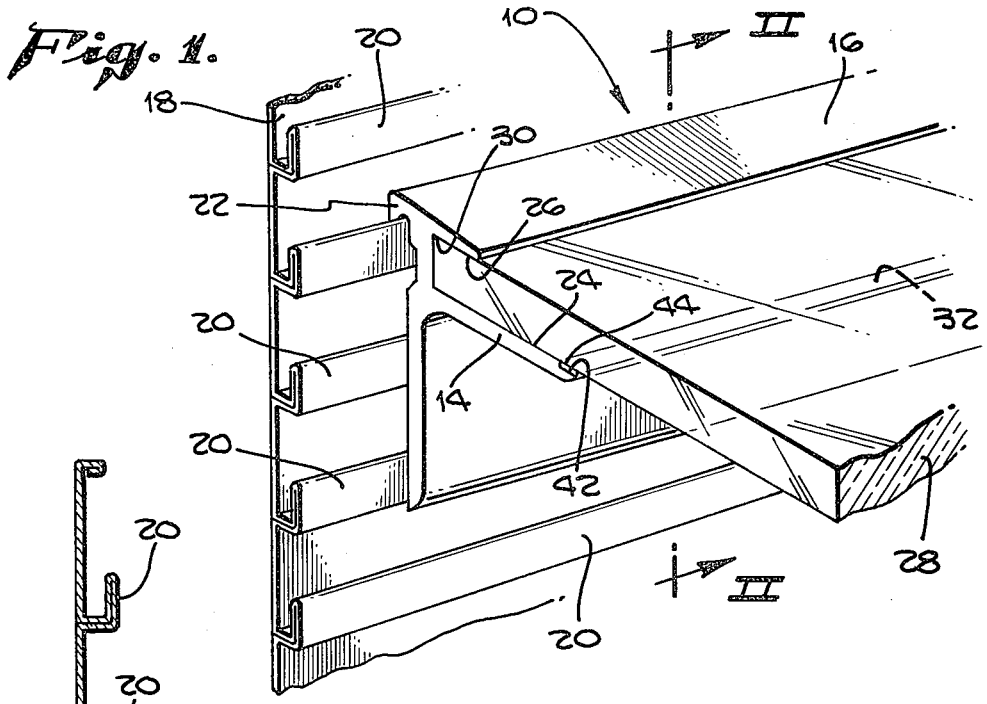
Fig. 2.
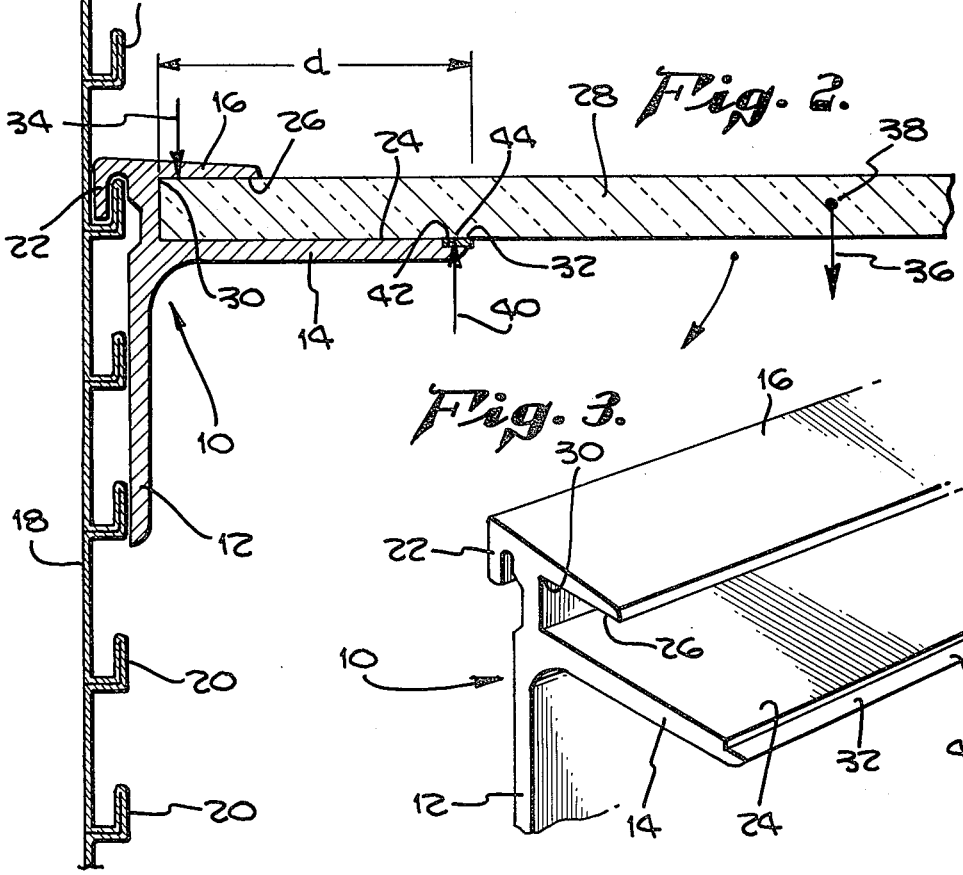
Fig. 3.

DISPLAY PANEL SHELF BRACKET

BACKGROUND OF THE INVENTION

The present invention relates to shelf brackets and, more particularly, to brackets to be used in association with alterable display panels for the holding of glass shelves.

In merchandise display panels a back panel is typically provided with a surface to which various display fixtures can be attached. One example of such panels is that referred to as "pegboard". Pegboard panels have a regular horizontal and vertical pattern of holes therethrough into which various wire-based fixtures can be attached. Another type of panel is that sold by the assignee of this application under the trade name UNIWEB. These panels have horizontal gripping ridges at regular intervals to which fixtures can be securely hooked.

Particularly in commercial displays, the fixtures extending from the panel should provide a minimum of interference with both customer movement throughout the display and between the products as displayed themselves. This is particularly true with shelving. What is desired is a simple means for attaching a shelf in a manner to resist displacement under normal conditions while, at the same time, being easily positionable. Ideally, such a bracket should also accommodate a variety of shelf sizes without the need for adjustment.

Several shelf brackets of relevance are known in the art. For example U.S. Pat. No. 1,702,937, by M. N. Friedmann, shows a complex shelf bracket which is adjustable and is attached by screws to a specialized column in a back panel or the like. Such a bracket is costly to manufacture, must be adjusted each time it is used, and, what is more, it is extremely ugly. A vertical projection at the forward edge of the bracket is utilized to prevent the shelf from slipping off of the bracket.

MacDuff, in U.S. Pat. No. 883,323, shows a bracket usable only on softer materials such as wood since gripping of the shelf is accomplished by teeth on the inner surfaces which physically penetrate the shelf surface and embed themselves therein to hold the shelf in place.

The glass shelf bracket of U.S. Pat. No. 3,202,296, to Diack, physically grips the glass around the edges with clips at both the front and rear surfaces to prevent its movement.

Meyer, in his U.S. Pat. No. 2,141,008, shows a glass shelf bracket which grips the glass shelf from the sides by a longitudinal compressing force exerted by a bolt which extends the length of the glass shelf between the two brackets.

Wherefore, it is the object of the present invention to provide a simple esthetically pleasing, secure itself bracket which can easily hold shelves of varying widths, lengths, and materials.

SUMMARY

The foregoing objectives have been met by the bracket of the present invention which comprises a back portion including means for holding the back portion horizontally disposed against a panel; a lower support portion extending outward from the back portion and having a top surface upon which the shelf can rest, the top surface having a front edge disposed equally distant from the panel when the bracket is attached to the panel; and an upper support portion extending outward from the back portion above and parallel to the top surface of the lower support portion and having a bearing bottom surface adjacent the back portion adapted to bear along the top inner edge of a shelf disposed in the bracket between the lower and upper support portions. To grip the shelf and prevent its pulling out of the bracket in normal use, the front edge is placed a distance away from the bearing surface which is short enough such that the weight of the shelf extending beyond the front edge will tend to rotate the shelf about the front edge and against the bearing surface to thereby cause a gripping action on the shelf while, at the same time, the distance is long enough that the lower support portion can support the shelf in a horizontal position.

In the preferred embodiment, the front edge has a high coefficient of friction to assist in gripping the shelf. This is accomplished by having a narrow groove at the front edge into which is placed on adhesive-backed strip of material having a high coefficient of friction.

The bracket of the present invention in its preferred embodiment is constructed of aluminum extrusion so as to be of unitary construction.

DESCRIPTION OF THE DRAWINGS

FIG. 1 is a perspective view of the bracket of the present invention attached to a panel and holding a glass shelf thereto.

FIG. 2 is a cutaway side view through the panel, bracket, and shelf of FIG. 1 in the plane II—II.

FIG. 3 is a perspective view of the bracket of the present invention.

DESCRIPTION OF THE PREFERRED EMBODIMENT

The particular bracket to be described hereinafter is a commercial embodiment particularly adapted to be used with the previously mentioned UNIWEB display panels of the assignee of the present invention which are described with particularity in U.S. Pat. No. 3,698,565. It should be understood that the principles could equally be accomplished by changing the back portion to cooperatively interact with a pegboard panel, slot-mounting hardware, keyhole mounting hardware or the like. By providing a flat surface on the back portion and holes therethrough, the bracket of the present invention could also be affixed directly to a wall or panel with screws, bolts, or the like.

Referring to the figures, it can be seen that the bracket, generally indicated as 10, comprises a back member 12 from which extends a lower support member 14 and an upper support member 16. As can be seen, the UNIWEB panels 18 of the assignee contain gripping ridges 20 on the surface which can be gripped by the varying fixtures employed therewith. Accordingly, the back member 12 has a gripping edge 22 formed therein which can be releasably attached over one of the ridges 20 to position the back member 12 horizontally along the panel 18 in a horizontal direction.

The lower support member 14 and upper support member 16 extend horizontally outwardly from the back member 12 in parallel relationship and normal to the back member 12. They are, therefore, in parallel horizontal planes. The top surface 24 of the lower support member 14 is spaced away from the bottom surface 26 of the upper support member 16 the thickness of the shelf 28 to be placed therebetween. The principles of the bracket of the present invention will work equally well with glass, plastic, wood, particleboard, Masonite, or the like. The distance between the top and bottom surfaces 24, 26 need only be made to accomodate the desired shelf thickness. While it is preferred and shown that the top and bottom surfaces 24, 25 are planar and parallel, it should be understood from the principle of operation to be described hereinafter that, for example, the lower support member 14 could be curved, concave downwardly, as viewed in the cross-section of FIG. 2 without adverse results.

The points of criticality are the relationship between the upper inner edge 30 and the top front edge 32 in conjunction with the distance therebetween, indicated as "d" in the drawing of FIG. 2. The upper inner edge 30 and the top front edge 32 must be parallel. This is easily accomplished by the preferred method of making the unitary form of the bracket of the present invention by extruding it of a hard aluminum which resists bending. In the assignee's commercial version, 6063T5 aluminum is used. By so doing, both the upper inner edge 30 and top front edge 32 are at a constant distance from the back member 12 which puts them in parallel relationship to one another. The length of the upper support member 16 is of little concern as long as a sufficient upper inner edge 30 is provided to bear against the inner top edge of the shelf 28 along the length thereof as indicated by the arrow 34. The distance "d" is chosen to be long enough and the thickness of the lower support member 14 is such that lower support member 14 can support the weight of the shelf 28 without bending. On the other hand, distance "d" is short enough such that the weight of the shelf 28, as symbolized by the arrow 36 through the center of gravity 38, will tend to pivot the shelf 28 about the top front edge 32 along its length as symbolized by the arrow 40. The result is a couple comprising the downward force 34 and the upward force 40 which tends to pinch or grip the shelf 28 to prevent its movement from out of the bracket 10 under normal conditions. In the commercial version, "d" is 2.0 inches for a 3/8 inch glass shelf.

To provide extra security, the top front edge 32 is made to have a high coefficient of friction. In the preferred embodiment, this is accomplished by providing a thin groove 42 into which is placed an adhesive-backed tape 44 of a material having a high coefficient of friction. In the commercial embodiment manufactured and sold by the assignee of this application, tape 44 is preferred to be a tape sold by the 3M Company as Series SJ-5800 resilient roll stock.

Wherefore, having thus described our invention, we claim:

1. A unitary bracket for holding a shelf to a panel as its sole support, said bracket comprising;

(a) a back portion including means for holding said back portion horizontally disposed against the panel;

(b) a lower support portion extending horizontally outward from said back portion and having a top surface upon which the shelf can rest, said top surface having a front edge disposed equally distant from the panel when the bracket is attached to the panel;

(c) an upper support portion extending outward from said back portion above and parallel to said top surface of said lower portion and having a bearing bottom surface adjacent said back portion adapted to bear along the top inner edge of a shelf disposed in the bracket between said lower and upper support portions, said front edge being a distance away from said bearing surface short enough being that the weight of the shelf extending beyond said front edge will tend to rotate the shelf about said front edge and against said bearing surface to thereby cause a gripping action on the shelf while, at the same time, said distance is long enough that said lower support portion can support the shelf in a horizontal position; and (d) wherein said back portion, lower support portion and upper support portion are formed integrally of each other and together form a longitudinally extending shelf edge receiving channel closely fitting and coextending with adjacent marginal areas of the edge of said shelf received therein;

(e) wherein said front edge of said top surface of said lower support portion is provided with a groove coextensive with the longitudinal extent of said front edge and; a strip of material having a high coefficient of friction coextensive with and fixedly disposed in said groove is provided whereby the retention of said shelf in said channel is facilitated.

2. A unitary bracket for removably holding a shelf to a display panel having gripping means, said bracket comprising:

(a) a longitudinal planar back member including means for cooperating with the gripping means to removably hold said back portion to the panel;

(b) a longitudinal planar lower support member disposed normal to said back member to form a horizontal top surface upon which the shelf can rest, said top surface having a front edge disposed equally distant from the panel when the bracket is attached to the panel;

(c) a longitudinal planar upper support member disposed normal to said back member above and parallel to said top surface of said lower support member and having a bearing bottom surface adjacent said back member adapted to bear along the top inner edge of a shelf disposed in the bracket between said lower and upper support members, said front edge being a distance away from said bearing support short enough such that the weight of the shelf extending beyond said frong edge will tend to rotate the shelf about said front edge and against said bearing surface to thereby cause a gripping action on the shelf while, at the same time, said distance is long enought that said lower support member can support the shelf in a horizontal position; and (d) wherein said back portion, lower support portion and upper support portion are formed integrally of each other and together form a longitudinally extending shelf edge receiving channel closely fitting and coextending with adjacent marginal areas of the edge of said shelf received therein and whereby said bracket is the sold support for said shelf;

(e) wherein said front edge of said top surface of said lower support portion is provided with a groove coextensive with the longitudinal extent of said front edge and; a strip of material having a high coefficient of friction coextensive with and fixedly disposed in said groove is provided whereby the retention of said shelf in said channel is facilitated.

3. A unitary bracket for removably holding a shelf comprising:

a longitudinal planar back portion adapted for horizontal attachment to a vertical surface, said back portion having a pair of longitudinal, spaced, opposed gripping portions extending normally outward from said back portion and being coextensive with the longitudinal extent of said bracket and the shelf removably held thereon, said gripping portions being spaced apart a distance to allow a shelf to be disposed therebetween and being sized to provide a top inner surface bearing on the upper inner edge of a shelf disposed in the bracket and a bottom inner surface bearing on the lower surface of a shelf disposed in the bracket to effect a gripping couple on the shelf from the weight of the shelf extending beyond said bottom inner surface;

wherein said bottom inner surface has a front edge disposed equally distant from said top inner surface about which the shelf attempts to rotate to create said couple, said front edge is provided with a groove coextensive with the longitudinal extent of said front edge; and a strip of material having a high coefficient of friction coextensive with and fixedly disposed in said groove is provided whereby retention of said shelf between said gripping portions is facilitated.

* * * * *